US009487029B2

(12) United States Patent
Gerlach et al.

(10) Patent No.: US 9,487,029 B2
(45) Date of Patent: Nov. 8, 2016

(54) METHOD TO CONTROL A SUBSTRATE TEMPERATURE, AS WELL AS PRINTING SYSTEM TO PRINT TO A SUBSTRATE

(71) Applicant: Oce Printing Systems GmbH & Co. KG, Poing (DE)

(72) Inventors: Sabine Gerlach, Munich (DE); Thomas Montag, Unterhaching (DE); Michael Has, Erding (DE)

(73) Assignee: Océ Printing Systems GmbH & Co. KG, Poing (DE)

( * ) Notice: Subject to any disclaimer, the term of this patent is extended or adjusted under 35 U.S.C. 154(b) by 0 days.

(21) Appl. No.: 15/016,439

(22) Filed: Feb. 5, 2016

(65) Prior Publication Data

US 2016/0229203 A1 Aug. 11, 2016

(30) Foreign Application Priority Data

Feb. 10, 2015 (DE) ..... 10 2015 101 858

(51) Int. Cl.

| | |
|---|---|
| ***B41J 2/01*** | (2006.01) |
| ***B41J 11/00*** | (2006.01) |
| ***B41F 23/00*** | (2006.01) |
| ***B41J 23/02*** | (2006.01) |
| ***B41J 2/045*** | (2006.01) |

(52) U.S. Cl.

CPC ..... *B41J 11/002* (2013.01); *B41F 23/007* (2013.01); *B41J 2/0454* (2013.01); *B41J 11/0015* (2013.01); *B41J 23/02* (2013.01); *B65H 2301/5142* (2013.01)

(58) Field of Classification Search

CPC ..... B41F 23/007; B65H 2301/5142; B41J 23/02; B41J 2/0454; B41J 11/0015; B41J 11/002

See application file for complete search history.

(56) References Cited

U.S. PATENT DOCUMENTS

| | | | | |
|---|---|---|---|---|
| 5,651,863 | A * | 7/1997 | Van Haag | D21G 1/0093 100/38 |
| 6,223,448 | B1 | 5/2001 | Motzke et al. | |
| 6,293,668 | B1 * | 9/2001 | Kubby | B41J 11/0015 347/101 |
| 6,923,121 | B2 | 8/2005 | De Vroome | |
| 2013/0070017 | A1 * | 3/2013 | Fujii | B41J 2/14274 347/20 |
| 2015/0283828 | A1 * | 10/2015 | Aoai | B41M 5/0017 428/207 |

FOREIGN PATENT DOCUMENTS

| | | | |
|---|---|---|---|
| DE | 1101447 | B | 3/1961 |
| DE | 1293565 | B | 4/1969 |
| DE | 3334077 | A1 | 4/1985 |
| DE | 19901801 | C2 | 7/2000 |
| DE | 10231598 | A1 | 2/2003 |
| EP | 0463213 | A1 | 1/1994 |

* cited by examiner

*Primary Examiner* — Julian Huffman
(74) *Attorney, Agent, or Firm* — Schiff Hardin LLP

(57) ABSTRACT

In a method or system to control a temperature of a substrate to be printed to and which exhibits said temperature during a traversal of a printing system, specifically selecting or controlling a fluid temperature of a liquid fluid to be applied onto the substrate to specifically influence the substrate temperature, the fluid being applied onto the substrate before the substrate is printed to. At least one of the fluid temperature and a quantity of the fluid applied onto the substrate per time unit at least depending on at least one of a first measurement value for a temperature of the substrate before the application of the fluid and a second measurement value for a surface temperature of the substrate after the application of the fluid.

21 Claims, 4 Drawing Sheets

METHOD TO CONTROL A SUBSTRATE TEMPERATURE, AS WELL AS PRINTING SYSTEM TO PRINT TO A SUBSTRATE

BACKGROUND

The present disclosure generally concerns the field of methods and arrangements that are used to print to a substrate.

Printing to a substrate—for example a paper or cardboard or the like—may in general take place by means of the most varied printing methods, for example by means of offset printing methods or digital printing methods. It is hereby known that different printing methods react with different sensitivity to changes, for example of the ambient temperatures and/or the ambient moisture. Changes in ambient temperature and/or ambient moisture may lead to altered print results, altered print quality and/or to altered capability for further processing, for example via folding, bending, binding, cutting etc.

This circumstance is presently often confronted in that the substrate to be printed to is either stored directly in the immediate environment of a printing machine or printing line with which the substrate should be processed, or in that the storage of the substrate takes place in a special heated storage space in which the climatic conditions (primarily temperature and moisture) are as similar as possible to those in the printing room. In this way it should be achieved that the substrate may adapt (with regard to temperature and moisture) to the conditions in the printing room. In addition to this, the substrate may be exposed with radiant heaters, for example, and thus may be warmed. A warming of the substrate may also take place with the aid of saddle heaters.

If the substrate must be stored for a non-negligible time—for example one day or longer—under the corresponding conditions for the adaptation to (for example) the temperature, this conventional procedure leads to a significant space requirement in the printing room, and resulting from this to significant costs, since the modern printing lines can process large quantities of substrate in this time. In addition to this, the print result and/or the result of further processing may furthermore fluctuate due to—for example—seasonally changing ambient temperature and ambient moisture under which printing and storage take place.

This is a state which may be improved.

SUMMARY

It is an object to specify a method and a printing system that enable it to be possible to execute the printing process and/or the further processing cost-effectively and with little effort (in particular with low space requirement), under conditions that are as advantageous as possible for the printing and/or the further processing of the printed materials and that are largely independent of the temperature ratios in the environment of a printing machine.

In a method or system to control a temperature of a substrate to be printed to and which exhibits said temperature during a traversal of a printing system, specifically selecting or controlling a fluid temperature of a liquid fluid to be applied onto the substrate to specifically influence the substrate temperature, the fluid being applied onto the substrate before the substrate is printed to. At least one of the fluid temperature and a quantity of the fluid applied onto the substrate per time unit at least depending on at least one of a first measurement value for a temperature of the substrate before the application of the fluid and a second measurement value for a surface temperature of the substrate after the application of the fluid.

DESCRIPTION OF EXEMPLARY EMBODIMENTS

Figure 1:
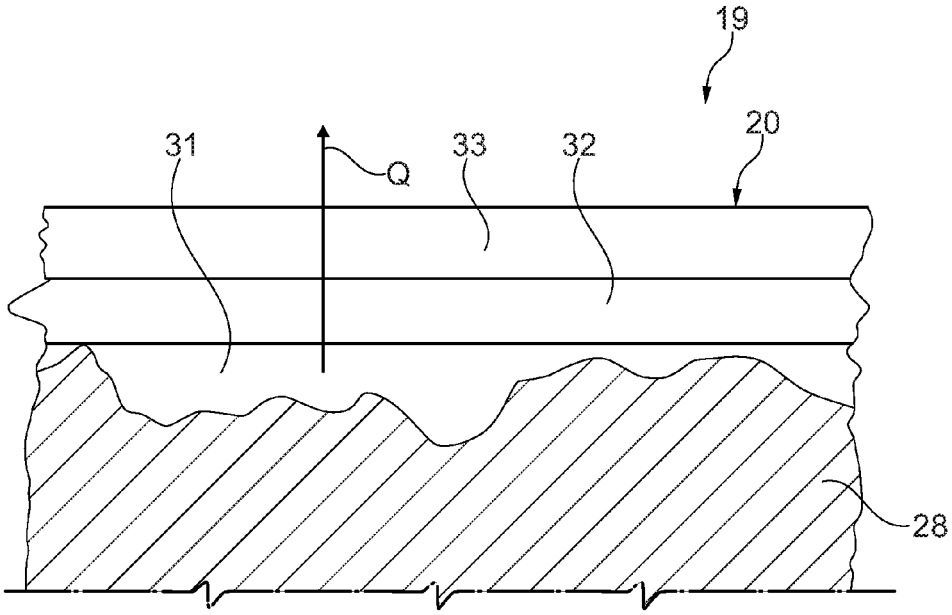
FIG. 1 is a schematic cross section through an example of a substrate.

For the purposes of promoting an understanding of the principles of the disclosure, reference will now be made to the preferred exemplary embodiments/best mode illustrated in the drawings and specific language will be used to describe the same. It will nevertheless be understood that no limitation of the scope of the of the disclosure is thereby intended, and such alterations and further modifications in the illustrated embodiments and such further applications of the principles of the disclosure as illustrated as would normally occur to one skilled in the art to which the disclosure relates are included herein.

Accordingly, a method is disclosed for controlling a substrate temperature (in particular a substrate surface temperature) which substrate to be printed to exhibit during a traverse of a printing system, wherein a fluid temperature of a fluid to be applied onto the substrate is specifically selected or controlled, and the fluid brought to the fluid temperature is applied onto the substrate, and the substrate temperature is hereby specifically effected.

According to an exemplary embodiment, a printing system is also disclosed for printing to a substrate, in particular by means of a digital printing method, wherein the printing system has at least one applicator to apply a fluid to the substrate and at least one temperature adjuster. The temperature adjuster is provided in order to bring the fluid to a specifically selected or controlled fluid temperature. The printing system according to the exemplary embodiment is designed for the implementation of a method to control a substrate temperature according to the exemplary embodiment.

The idea forming the basis of the present exemplary embodiment is to select or control, in a targeted manner, the temperature of a fluid that should be applied onto the substrate. In that this fluid is applied onto the substrate, the temperature of the substrate may be specifically affected (and thus controlled) while this travels through the printing system. A parameter of the substrate that is relevant to the printing method and/or the further processing—namely the temperature of the substrate itself—may thus be specifically adjusted independently of the conditions in the environment of the printing machine and, for example, may advantageously be kept constant at an optimal value. Given the exemplary embodiment, a direct effect on the substrate temperature thus takes place without a detour via the ambient temperature. A storage of the substrate—for example in the form of voluminous paper rolls—in the direct environment of the printing machine may be avoided, whereby a significant savings in space and costs may advantageously be achieved given precisely the printing lines that, presently, are often long in any event. The control of the substrate temperature may additionally be realized with little effort given the present exemplary embodiment.

The temperature of the substrate that is affected by means of the fluid may presently be in particular a surface temperature of the substrate, thus the temperature in a surface region of said substrate. Alternatively, however, if needed the affected substrate temperature may also be a temperature inside the substrate or across its entire cross section. The temperature of the substrate may vary along the path of the substrate upon traversing the printing system. Presently, a targeted influencing of the substrate temperature that the substrate exhibits during the traversal of the printing system may also in particular be understood as a targeted influencing of a substrate temperature at one point or in a region of the run path of the substrate.

The present exemplary embodiments are explained in detail in the following drawing figures.

These drawing figures impart a further understanding of the embodiments of the disclosure. They illustrate embodiments and—in connection with the Specification—serve for the explanation of principles and concepts of the exemplary embodiments. The elements of the drawings are not necessarily shown true to scale relative to one another.

Identical, functionally identical and equivalent elements, features and components are—insofar as not stated otherwise—are respectively provided with the same reference characters in the drawing figures.

A cross section through a substrate 19 in an initial state is shown in FIG. 1 in the example of a cross section through a paper. In the initial state (meaning without having been subjected to a method according to any of the exemplary embodiments), the substrate 19 of FIG. 1 may, for example, be an offset paper that is currently typical, which offset paper may in particular be adapted to the requirements of the offset printing method.

Only an upper half of the cross section of the substrate 19 is depicted in FIG. 1. A substrate surface is designated with the reference character 20. As arises from FIG. 1, the substrate 19 has a fibrous raw substrate 29 (a raw paper, for instance). The raw substrate 28 is a relatively rough, fibrous material. Three strokes 31, 32, 33 are applied onto the raw substrate 28 in FIG. 1, which three strokes 31, 32, 33 serve (among other things) for the smoothing of the material and are designated as coatings in the case of a paper. Of the strokes, the upper strokes 32, 33 may in particular also serve for the coloration of the substrate 19 (white, for example). One or more such strokes 31, 32, 33 may include a number of different materials or substances, among them for example $CaCO_3$, $TiO_2$ and/or $Al_2O_3$, as well as binder. Instead of the three shown strokes 31, 32, 33, more strokes (four strokes, for example) or instead fewer strokes could also be provided.

In the presently described exemplary embodiments, the substrate 19 is preferably processed via printing in digital printing methods, for example a liquid toner-based or dry toner-based electrographic printing method. However, a printing to the substrate 19 could also be provided in an inkjet process. Alternatively, instead of being printed to in a digital printing method, the substrate 19 could be printed to in an offset process.

In the initial state, the substrate 19 is not a homogeneous substance, as is clear from FIG. 1. A substrate 19 (for instance a paper as it is shown in FIG. 1, or a cardboard or the like) may be inhomogeneous internally, but in particular also in the area of its surface 20. For example, inhomogeneities may be present with regard to the capillary diameter in the substrate 19 or its optical properties. The thickness of the stroke arrangement 31-33 in the transverse direction Q varies in the area, i.e. in a plane parallel to the substrate top side 20. The absorption capability of the substrate 19 (which affects the strike-in behavior of an applied liquid) and the electrical resistance or the electrical conductivity of the substrate 19 may likewise vary in the area, for example. Depending on the selected printing method, such inhomogeneities may have different effects on the achieved print result, in particular may lead to a print quality differing over an area, for example entail irregularities with a period on the order of approximately 0.3 mm to approximately 1.3 mm. Given liquid toner processes, for example, variations in the electrical resistance and in the absorption capability over an area may have such effects; and given dry toner processes, variations of the electrical resistance may have such effects.

Figure 2:
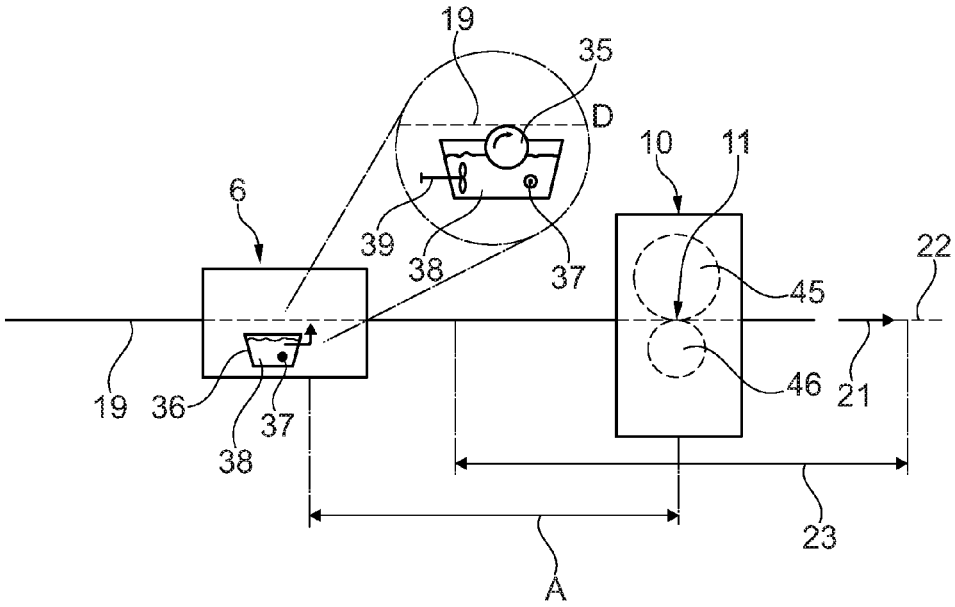
FIG. 2 shows a portion of a printing system according to a first exemplary embodiment of the disclosure, together with a detail view D, in a schematic side view.

Some components of a printing system (which is not entirely visible in FIG. 2) are depicted in FIG. 2. The printing system may be a printing machine or a printing line, in particular for digital printing. The printing system may hereby include not only one or more print groups 10 but rather in addition: devices to supply and/or unroll substrate 19 (for instance paper or cardboard); devices for substrate transport; a coating group; as well as devices for further processing of the substrate 19 via rolling up or cutting, as well as stacking, bending, folding, binding, cutting to size and the like.

As is clear from FIG. 2, a printing system according to a first exemplary embodiment has a fluid applicator 6 as well as a print group 10. The substrate 19 is transported in the travel direction 21 along a provided path 22 through the printing system. The schematically shown fluid applicator 6 is shown in part with magnification and more detail in detail view D. The fluid applicator 6 serves for the application of a fluid 38 (whose functions are explained further in the following) onto the substrate 19.

An example of a design of the fluid applicator 6 is schematically drawn in FIG. 2. The fluid applicator 6 hereby has a fluid container 36 with the fluid 38 located therein. A temperature adjuster 37 is located in the fluid container 36, which temperature adjuster 37 is, as a heater, designed with a temperature sensor (not drawn) coupled with said heater and, for example, also a suitable regulator for controlling or regulating the fluid temperature. The temperature adjuster 37 serves to adjust (i.e. to temper) the temperature of the fluid 38 (designated in the following as a fluid temperature) to a constant value, or a value varying over time in a predefined or specifically determined manner. In general, an influencing of temperature or an adjustment to a desired temperature should presently be understood as a tempering. A tempering may exist as a temperature increase or, instead of this, a temperature decrease.

In the example of FIG. 2, a corresponding regulation of the fluid temperature preferably takes place under consideration of the measurement value of the temperature sensor (not shown). The heater of the temperature adjuster 37 may be designed with an insulated, electrically operated heating element or another suitable heater. As the detail D of FIG. 2 shows, a stirrer 39 may additionally be provided in the fluid container 36, which stirrer 39 ensures that the fluid 38 in the fluid container 36 circulates and is uniformly tempered in this way. In the event that the temperature adjuster 37 should produce a cooling of the fluid 38, in one variant it may have a corresponding cooling device instead of the heater. In a further variant, the temperature adjuster 37 may have both a heater and a cooler if a heating or cooling of the fluid 38 should take place at different points in time.

The fluid applicator 6 of FIG. 2 also has an applicator 35 which removes the fluid 38 from the fluid container 37 and applies it to the substrate 19. For example, the applicator 35 may have a drum with cells. However, instead of this, other ways (that are customary to the person skilled in the art) for applying a fluid 38 to a moving substrate (a running paper web, for instance) could likewise be used. For example, an applicator with a number of suitable application nozzles could also be used. It is understood that the depiction of FIG. 2, with the applicator 35 below the substrate 19, is schematic, and that instead of this the application of the tempered fluid 38 onto the substrate 19 may take place from above, or from below and above on both sides of the substrate 19. In a preferred variant, the application of the tempered fluid 38 takes place (and in this way a conditioning of the substrate 19 takes place) from the same side from which the printing also takes place.

In FIG. 2, the print group 10 is drawn in an example with two drums 45, 46, wherein this depiction is also to be understood as purely schematic, and the print group 10 may be designed in the most varied ways (for instance with more drums and with multiple additional devices that contribute to the printing). For example, the print group 10 may be provided for a printing to the substrate 19 in a liquid toner-based or dry toner-based digital printing method. However, it would also be conceivable to print to the substrate 19 by means of the print group 10 in an inkjet process or, even further alternatively, in an offset process.

Moreover, a distance A between the location of the application of the fluid 38 to the substrate 19 and the location at which the printing takes place (i.e. any location at which the ink or toner transfer to the substrate 19 takes place in the print group 10) is drawn in FIG. 2.

Further additional print groups and/or a coating group and/or a further processor with devices to bind, stack, fold, bend or cut the substrate 19 (which are not shown in FIG. 1 for the sake of clarity) may follow the print group 10.

In the first exemplary embodiment, the fluid 38 may also be designated as a primer. The fluid 38 is in particular present as a liquid and thus may also be designated as a primer liquid. One or more properties of the substrate 19 may be adapted by means of the fluid 38 to the respective particular requirements of the printing method that is to be used, i.e. for example the requirements of a liquid toner process, a dry toner process or, instead of these, an inkjet process. In this way, by means of the application of the fluid 38 to the substrate 19 (which takes place at a location in the substrate path 22 upstream of the print group 10, and thus before the printing), the substrate 19 is prepared for the subsequent printing in the print group 10.

In the event that the print group 10 is designed for offset printing, the fluid 38 could be what is known as a dampening solution which may likewise be present in liquid form.

For the preparation of the substrate 19 by means of the fluid 38, a substrate property of the substrate 19 is selected, or multiple substrate properties of the substrate 19 are selected, under consideration of the printing method by means of which the substrate 19 should be printed to in the print group 10. By means of the application of the fluid 38 in the fluid applicator 6, before the printing a targeted homogenization (and thus targeted adjustment) of the selected substrate property or substrate properties takes place in the directions of the planar extent of the substrate 19.

In particular, one or more of the following properties are considered as specific substrate properties or substrate parameters that are to be homogenized, and thus in particular are to be adjusted:

an absorption capability of the substrate 19;
a wetting capability of the substrate 19;
an electrical resistance of the substrate 19;
an electrical conductivity of the substrate 19;
an electrostatic charging capability of the substrate 19.

The homogenized substrate properties may be different depending on the selected printing method. For example, a homogenization of the absorption capability may be useful for a printing in the inkjet process or in the liquid toner process and be advantageous for the print result. For example, in this way a non-uniform deposition of toner particles from the carrier fluid of a liquid toner may be reduced. A homogenization of electrical properties (such as resistance, conductivity or static charging capability) may in particular take place given electrographic processes such as liquid toner or dry toner processes, and be advantageous for a uniform migration of toner particles to the points of the substrate surface 20 that are to be inked. A homogenization (and thereby an adjustment) of a chemical property of the substrate 19 may also be considered as needed. For example, in the event of an inhomogeneous distribution of a substance/material (for example of a binder or a salt) in a substrate, a chemical property that is ascribed to this substance/material could be made uniform via the homogenization by means of the fluid 38.

As shown in FIG. 1, the substrate 19 may have one or more strokes 31, 32, 33. The properties homogenized by means of the fluid 38 may be properties of the entire substrate or properties of one of the strokes 31, 32, 33 in their entirety. For example, at least one of the homogenized substrate properties may thus be a property of the substrate 19 in the region of the substrate surface 20, for instance of one or more of the strokes 31, 32, 33.

In particular, for example, an electrical conductivity or an electrical resistance or an absorption capability within the entirety of the strokes 31, 32, 33 may be homogenized over the area and therefore may be adjusted.

The fluid 38 may include water, for example an aqueous solution or aqueous dispersion solution. The fluid 38 may include water as well as an additive substance or multiple additive substances that are added to the water. The additive substances and the water thus represent respective fluid components of the fluid 38. The fluid 38—as primer liquid, for example—may be a mixture of different components, wherein each of the ingredients or fluid components that are included therein may serve to optimize individual properties of the substrate 19. In the interaction of the individual ingredients, the desired homogenization of the substrate properties may be achieved with the aid of an optimized mixture. Instead of a liquid, however, a gas may also be used as a fluid 38 for optimization of the substrate properties via homogenization.

For example, the fluid 38 (which, according to the first exemplary embodiment of FIG. 2, is applied onto the substrate 19 by means of the fluid applicator 6) may include water and a binder-like additive substance. The binder-like additive substance may be used for a homogenization of the absorption capability of the substrate 19 in the plane of its areal extent, and to achieve a more homogeneous strike-in behavior of applied fluids. What is known as "strike-in" is the penetration of a liquid applied onto a substrate 19 (such as paper, for instance) into said substrate 19. Binder-like substances are in many cases already present in substrates such as printable papers. Irregularities in the absorption capability that are present may be compensated for via the introduction of additional binder-like substances. The binders or binder-like substances may be suitable polymers, for example.

The water proportion of the fluid 38 may be used for areal homogenization of the electrical resistance of the substrate 19. In one variant, a suitable salt may additionally be added to the fluid 38 to assist in the homogenization of the electrical resistance or of the electrical conductivity.

In the field of digital printing, a homogenization of the electrical resistance of the substrate 19 has advantages given liquid toner and dry toner processes. The homogenization of the absorption capability may in particular have an advantageous effect given liquid toner processes.

In order to implement the homogenization, the amounts of fluid 38 that are to be applied onto the substrate per area unit of said substrate, and the temperature of the fluid 38, as well as its composition, are to be suitably selected and adjusted to one another, as well as to the substrate 19 and the printing method. In the event that one or more additive substances in water are used for the fluid 38, the composition may be understood as concentrations of the additive substances in the fluid 38. In the selection for the fluid quantity that is applied to the running substrate 19 per time unit, and thus for a given travel or transport velocity of the substrate 19 per area unit, it is to be heeded that the mechanical structure of the substrate 19 is not destroyed by too great an amount of water, for example.

In an advantageous additional variant, the fluid 38 may also be designed to affect the behavior of the carrier fluid for the toner (carrier) in the event of a subsequent printing in an electrographic (for example electrophotographic) liquid toner process. The toner particles are suspended in the carrier. In this variant, the fluid 38 as primer liquid should ensure that the toner particles in the nip are transferred onto the substrate at their provided position, and optimally do not deviate from their nominal position due to the behavior of the carrier at this point, meaning that the position deviation upon transfer of the toner particles should be reduced or avoided. A manner of "short-term retention" of the carrier fluid is thus also sought via the primer liquid as fluid 38.

In order to achieve optimal print results and/or optimal results in the further processing (for example given folding, bending or binding) after printing, optimally independently of the prevailing environment conditions (in particular ambient temperatures and ambient moisture) that affect the climate in the printing room, in the first exemplary embodiment of the disclosure according to FIG. 2 the temperature of the substrate 19 is specifically influenced and controlled by means of the application of the fluid 38 during the traversal of the printing system. In particular, a substrate temperature of the substrate 19 may thereby be controlled at a selected location along the substrate path through the printing system, for example at the location 11 of the ink transfer or toner transfer in the print group 10. However, a control of the substrate temperature (as it is drawn in FIG. 2 purely as an example and for illustration) could also be implemented, wherein the targeted influence on the substrate temperature or "tempering" of the substrate 19 could last until the end of the path 22 of the substrate 19 through the printing system, or could include at least that region 23 in which the printing or processing steps are conducted whose results should be advantageously influenced by the control of the substrate temperature.

The substrate temperature to be controlled may hereby be a surface temperature of the substrate 19 if the influencing of the substrate surface temperature (i.e. of a temperature in a surface layer of the substrate 19, for example on the order of the thickness of the strokes 31-33) is already sufficient to achieve the desired printing properties or further processing properties. Alternatively, the temperature may be influenced over the entire thickness of the substrate 19, thus also inside it.

In the first exemplary embodiment of the disclosure (see FIG. 2), the fluid 38 is preheated by means of the temperature adjuster 37 before the application onto the substrate 19, and the heated fluid 38 is applied onto the substrate 19 before it is printed to. In order to specifically influence the substrate temperature by means of the tempered (here warm) fluid 38, the fluid temperature of the fluid 38 (which fluid temperature is effected by means of the temperature adjuster 37) is specifically selected or controlled such that the sought substrate temperature is set in the substrate 19, for example at the location 11 or in the region 23.

For combinations of printing methods and/or further processing processes and substrate 19, for example in which an increase of the substrate temperature yields a better result in printing or in further processing, the substrate temperature may thus be specifically adjusted for an optimized result.

In a preferred variant of the first exemplary embodiment of the disclosure, the fluid 38 comprises water. By means of the application of the fluid 38 to the substrate 19, it is thus achieved that a moisture content of the substrate (substrate moisture) is also to be specifically influenced in addition to a targeted control of the substrate temperature. With consideration of the moisture content of the substrate 19, a dependency of the printing result and further processing result on the environmental conditions may thus also be avoided, or at least result. For example, the moisture content at location 11 or in the region 23 (see above) may hereby be controlled.

The moisture content in the substrate 19 may thus be adjusted for optimized print quality and/or optimized capability for further processing of the printed substrate 19. By means of a specifically influenced moisture content, it is achieved that moisture-dependent properties (for instance the wetting capability) of the substrate 19, its electrical properties (such as resistance, conductivity and capacitance), but also mechanical properties (for instance the fragility upon bending or binding) are specifically influenced.

Given suitable adjustment of the substrate moisture, for example, what is known as the problem of "fracture in folding" in the post-processing of the printed substrate 19 may be avoided. The moisture content of the substrate 19 may also influence its running properties and be selected accordingly such that advantageous running properties are achieved.

It may be useful to control the substrate temperature and the moisture content in the substrate 19 in such a manner that these respectively assume a constant value selected under consideration of in particular the printing method and the substrate type, whereby these parameters no longer vary in a manner that is advantageous to the printing method.

A controller (not shown in FIG. 2) may be provided by means of which the fluid temperature as well as the amount of fluid that is applied to the running substrate 19 per time unit are controlled, depending on at least the type of substrate, its thickness and the print speed, in such a manner that as optimal a substrate temperature and substrate moisture as possible appear at least at a predetermined point or in a predetermined region of the path of the substrate 19 through the printing system, in particular at the location 11 of the printing by means of the print group 10, i.e. at the point in time of the transfer of a printing ink or toner onto the substrate 19.

In other words: the substrate temperature that should be specifically influenced may thus be a substrate temperature which the substrate 19 has upon coating (i.e. at the point in time of the transfer of a coating agent), wherein the coating agent may, for example, be a printing ink or a coating or a lamination, and may be drawn into the substrate 19 or remain as a layer on its surface.

In variants of the first exemplary embodiment, the substrate temperature and/or substrate moisture that should be specifically influenced may be a temperature of the substrate 19 and/or a moisture that the substrate 19 exhibits upon further processing or post-processing after printing, i.e. downstream of the print group 10 along the path 22 of the running substrate 19. The substrate temperature and/or the substrate moisture that the substrate 19 exhibits in a lamination process or the like could also be specifically influenced.

It may also be provided—for example in one variant of the first exemplary embodiment—that the substrate temperature downstream of the fluid applicator 6 (i.e. after this) does not fall below a predefined temperature value over a defined sub-region 23 of the path 22 of the substrate 19 through the printing system, or over the entire path of said substrate 19 downstream of the fluid applicator 6.

In this way, the substrate temperature may be optimally controlled for the actual printing or coating process, in particular the ink transfer or toner transfer or coating agent transfer onto the substrate, and/or for the post-processing/further processing.

The fluid temperature of the fluid 38 is advantageously specifically selected or controlled in such a way that the substrate temperature assumes a value above the ambient temperature or room temperature in the printing room, thus in the environment of the printing system and preferably above all ambient temperatures or room temperatures that may occur under the typical operating circumstances and environmental conditions. Similarly, the moisture content of the substrate 19 may also be increased beyond a moisture content that the substrate 19 would assume given storage under the climatic environment conditions in the environment of the printing system. In such variants, substrate temperature and substrate moisture are thus increased by means of the fluid 38 beyond their normal measurement present under ambient conditions. In this way, the working window within which the printing (and if applicable the further processing) of the substrate 19 takes place may be selected so as to be reproducible. Overall, the use of the fluid 38 to adjust the substrate temperature and substrate moisture thus enables not only an optimized result of printing (and if applicable further processing) in a printing line, but rather may also contribute to a constant good result over time. Such a procedure is advantageous in cases in which an increase of the substrate temperature beyond the ambient temperature results in a better printing result or further processing result.

The viscosity, surface tension and tack of liquids (such as a primer liquid, but also a printing ink) normally follow a temperature dependency of type $X=X=X0\cdot\exp(Ea/(k\cdot T))$, meaning that they decline for constant X0, Ea, k with increasing temperature T. In such an Arrhenius equation, X for example designates the viscosity, thus X0 designates a reference viscosity, Ea an activation energy and k the Boltzmann constant. If a glass transition occurs in the temperature range of interest, however, the aforementioned properties often no longer change according to the aforementioned equation. Diffusion processes are also temperature-dependent.

The heating of the fluid 38—and the increase of the substrate temperature that is thereby controlled, for example to values above the room or ambient temperature—thus have an additional advantageous effect because liquids such as primer liquids (as well as dampening agents, inks and general coating agents) may have improved penetration into the surface of the substrate due to the decreasing viscosities, surface tensions and/or tacks, which may likewise contribute to an additional improvement in the achievable print quality and reduce fluctuations of the print quality or coating quality.

After the application of a fluid 38 in liquid form to the running substrate 19 (in-line application), before the following printing by means of the print group 10 a sufficient time should be available in which the fluid 38 (applied as a liquid) may penetrate sufficiently. The substrate 19 travels in the direction 21 through the printing system. The distance A along the path 22 (see FIG. 2) is chosen in such a manner that, at the location 11 of the printing by means of the print group 10, only a predefined fraction of the amount of fluid 38 that is applied per area to the substrate 19 remains on the substrate surface 20. However, the speed with which the fluid 38 penetrates after the application by means of the fluid applicator 6 may also be controlled via targeted control of the fluid temperature of the fluid 38. A temperature increase facilitates the penetration of liquids into absorbent surfaces. The penetration is an absorption phenomenon and follows temperature dependencies. The time dependency of a penetrated quantity of liquid follows an exponential temperature characteristic of the type $dm/dt \sim 1/\text{Viscosity}(T)$, wherein T designates the temperature, m the mass of the quantity of liquid and t the time. Different liquid components may penetrate with different speed depending on their vapor pressure.

A warming of the fluid 38 thus enables an accelerated, faster penetration of the fluid 38, thus a shorter penetration time, and therefore enables a shorter distance A for a given printing speed, which has an advantageous effect on the total length L of the printing line (which is often quite long anyway, considering the devices—such as paper take-off and devices for further processing via cutting, folding, bending, binding, take-up, sorting etc.—situated before and after the print group 10). For a half-life of the penetrating amount of approximately 200 milliseconds, and given negligibility of a reverse lamination if only a small portion of the applied quantity of liquid still remains on the substrate surface 20, a distance A of approximately 0.6 meters (for example) results for a print speed of 1 meter/second.

In the first exemplary embodiment, as described in the preceding the substrate 19 exhibits, at the location of the printing 11 by means of the print group 10, a specifically controlled substrate temperature that is advantageous for the printing leads and that to print results that are as optimal as possible. In addition to this, as in the conventional procedure the substrate 19 does not need to be stored in the immediate proximity of the printing system for a longer time in order to assume the ambient temperature. The substrate moisture may likewise advantageously be controlled at a predefined location 11 or a predefined region 23.

A substance or primer in the form of a fluid 38 (in particular a liquid) is hereby used to adjust substrate temperature and substrate moisture, which fluid 38 may also be used for other purposes—for example, as already cited in the preceding, in order to achieve a large areal homogenization or averaging of selected substrate properties such as electrical resistance, electrical conductivity, electrostatic charging capability, absorption capability and/or wetting capability, or in order to influence additional properties (for example a running capability of the substrate 19).

In one variant, the fluid 38 could be cooled before the application on the substrate 19 in order to specifically select or control the fluid temperature of said fluid 38, for example such that the substrate temperature assumes a value below the ambient temperature or the room temperature in the printing room. This may be advantageous if it turns out that a selected printing method achieves particularly good results for a given substrate type precisely at substrate temperatures that are below the temperatures in the environment of the printing system. In particular, this could occur in environments with very high ambient temperatures.

Figure 6:
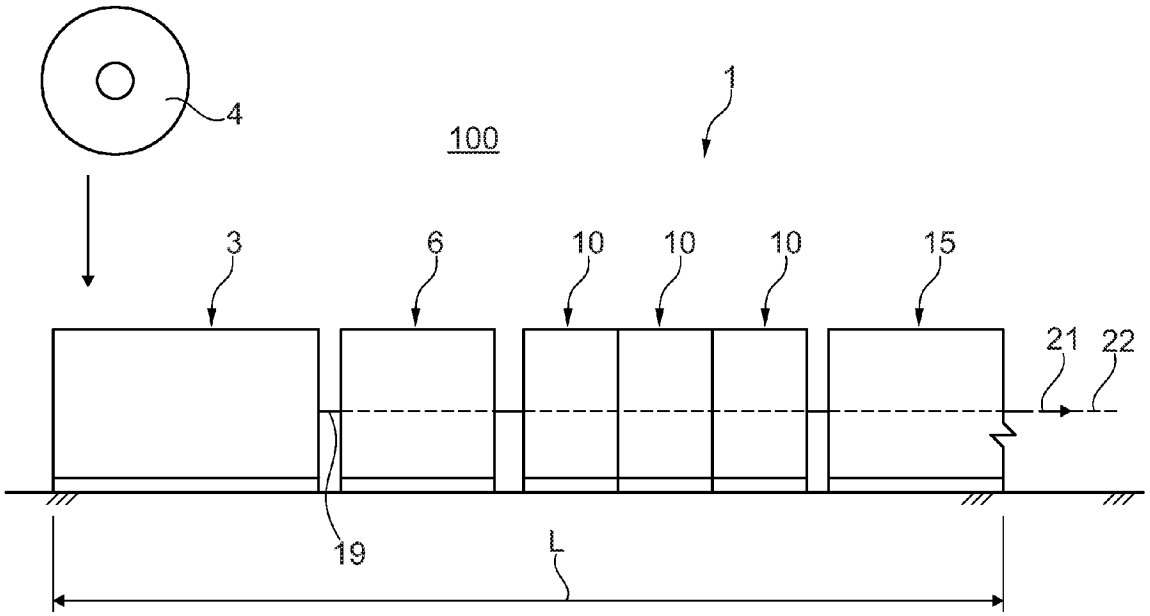
FIG. 6 is an example of a printing system according to a further exemplary embodiment of the disclosure, in a schematic side view.

The advantages of the apparatus of the fluid 38 by means of the fluid applicator 6 are also clear from FIG. 6, which—according to a further exemplary embodiment—shows a printing system 1 with a take-off 3 for the substrate 19, a fluid applicator 6 as has been described in the preceding with regard to the first exemplary embodiment, and with multiple successive print groups 10. The preceding statements are referenced regarding the application of the fluid 38 as well as its effects, and regarding the printing by means of the print group 10, as well as regarding the arrangement of print group 10 and fluid applicator 6. Arranged after the print groups 10 along the travel direction 21 of the substrate is a post-/further processor or final processor 15 that is designed for cutting, folding, bending, binding, stacking or for a rerolling of the substrate 19. The length of the printing system 1 is designated with L. It is clear from FIG. 6 that significant space savings may be achieved if a storage of the substrate 19 in the form of a greater number of voluminous paper rolls 4 (which are to be loaded bit by bit into the take-off 3) in immediate proximity to the printing system 1 (for adaptation to the climatic conditions of the environment 100 in the printing room) is avoided, and in addition to this the distance A (see FIG. 2 in this regard) between the fluid applicator 6 and the first print group 10 may be kept small. A small space requirement for the application of the fluid 38 is thus also achieved—the control of substrate temperature and substrate moisture, as well as the homogenization of selected substrate parameters, may thus take place at low cost and with a small additional space requirement.

The printing system 1 may be a digital printing machine or digital printing line. Digital printing methods are particularly well suited for frequently changing print jobs, which also may involve frequent changing of the substrate 19 to be printed to. The space savings due to the omission of a storage of a number of different substrates 19 in large quantities in the immediate proximity of a printing machine or printing line is therefore particularly advantageous in the case of digital printing methods.

In all exemplary embodiments of the disclosure, the supply feed of the substrate 19 may take place continuously from a roll 4 as described in the preceding and in the following, as schematically drawn in FIG. 6; however, instead of this the substrate 19 could also be supplied in the form of single sheets or webs, wherein then the printing system 1 of FIG. 6 is adapted accordingly.

On the one hand, as described above the distance (designated with A in FIG. 2) between fluid applicator 6 and print group 10 is chosen to be at least so great that the fluid 38 has penetrated sufficiently in order to enable a printing in the print group 10 at distance A for a given travel velocity. On the other hand, the distance A may also additionally be selected depending on the time that is necessary following the application of the fluid 38 so that a desired distribution of at least one of the components of the fluid 38 (in particular of an additive substance included in the fluid 38, or of multiple different such fluid components or additive substances) in the substrate 19 has appeared deep within said substrate 19 and on its surface. In particular at the location 11 of the printing in the print group 10, a predetermined distribution of the additive substance/fluid component or of the additive substances/fluid components that is/are included in the fluid 38 upon application may hereby be sought in the thickness direction or transverse direction Q of the substrate 19 (see FIG. 1), and this may be taken into account accordingly in the selection of the distance A. The desired distribution could be defined within one or more of the strokes 31-33 or their entirety, in particular in the thickness direction Q. In this way it could be ensured that a homogeneity of one or more selected substrate parameters is achieved via the attained distribution by means of the application of the fluid 38, in particular at location 11. In particular, by means of the application of the fluid 38 the substrate parameter(s) may respectively be adjusted to a sought target value, wherein the location of the application of the fluid 38 is selected such that the desired homogeneity and the sought target value have appeared at the desired location (in particular at the location of the printing).

As shown in the preceding, in the first exemplary embodiment of the disclosure a temperature adjustment or a tempering of a fluid 38 (for instance a coating agent, a primer, a dampening agent, an additive or in general a substance to be applied on the substrate 19 before the actual printing method)—preferably a liquid—thus takes place in order to hereby control the substrate temperature. The substance to be applied may, for example, also be a printing ink or a coating. The substrate temperature is thus controlled by means of a targeted selection or adjustment of the temperature of the applied substance. A regulation of the substrate temperature is likewise possible.

Substrate properties that are more homogeneous over an area are set by means of a homogenizing application of a fluid 38, in particular of a suitable liquid such as water with additive substances. In addition to this, the moisture content of the substrate is controlled or regulated.

The targeted influencing of substrate temperature and substrate moisture after the fluid applicator 6 (for example at a location 11 or in a region 23 of the substrate path 22) not only enables advantageous effects on the print quality and the further processing capability of the printed substrate 19, but can also enable a monitoring of the shrinkage of the substrate 19 during the traversal of the printing system. This may reduce the dimensions of the substrate 19 that are to be compensated, for example upon cutting of the printed substrate 19. An optimal tempering and liquid utilization of the substrate 19 may also make its shrinkage during the traversal of the printing system easier to reproduce. A regulation of the shrinkage is possible.

As already explained, the distance A along the travel path 22 of the substrate 19—for which distance A a minimum value may be determined from the travel velocity of the substrate on the one hand and, on the other hand, the time that the fluid 38 requires for a sufficient penetration—lies between the location of the application of the fluid 38 (in liquid form, for instance) and the subsequent first print group 10. For example, the travel velocity of the substrate 19 may be between approximately 1.0 meters/second and approximately 2.0 meters/second. An increase of the fluid temperature of the fluid 38 has an advantageous effect with regard to the possible printing speeds (and thus the travel velocities of the substrate) because higher printing speeds are possible for a given distance A due to the penetration speeds that are higher with increasing temperature.

Similarly, a targeted heating of the substrate 19 by means of the tempered fluid 38 has the further advantage that the carrier fluid used in liquid toner methods likewise penetrates faster, which in turn has an advantageous effect with regard to a possible limitation of the possible printing speeds due to the penetration speed of the carrier.

Multiple advantageous effects may thus be achieved simultaneously with only comparably small cost via the use of the fluid 38 both for the purposes of homogenization of the substrate properties and for the control of the substrate temperature and substrate moisture. Moreover, the tempering of the fluid 38 (for example by heating it) not only has a use in controlling the substrate temperature; rather, by using a heated fluid 38, this penetrates faster, meaning that the sought homogenization and (if applicable) adjustment of the selected substrate properties is achieved in a shorter amount of time. In some cases, a reduced amount of fluid may additionally be required for the homogenization, in particular in comparison with unheated fluid 38. On the other hand, with the aid of the heating of the fluid 38 it may be possible to place a sufficient amount of fluid 38 for the desired homogenization or adjustment of the substrate parameter(s) into the substrate 19 in the available time.

Given heating of the fluid 38, a deeper penetration into the substrate 19 of fluid components or additives included in the fluid 38 may also be achieved. The tempering of the fluid 38—in particular increasing or decreasing temperature—may thus be advantageously used for a targeted control of the penetration depth of one or more of the additive substances included in the fluid 38.

Figure 3:
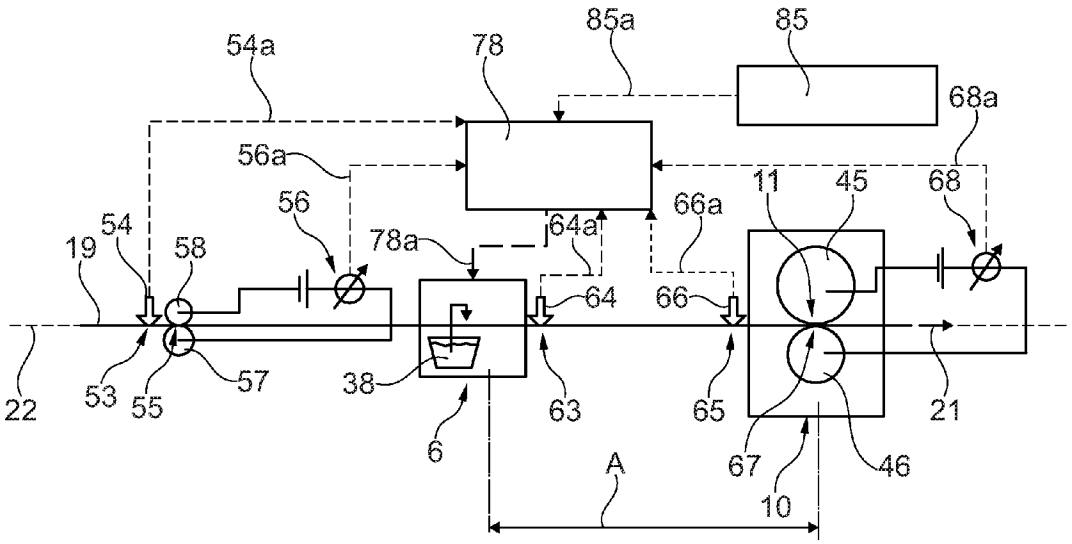
FIG. 3 illustrates a portion of a printing system according to a second exemplary embodiment of the disclosure, in a schematic side view, wherein a regulator, a database, measurers, and a few paths of data and measurement values are also drawn.

FIG. 3 shows a second exemplary embodiment of the disclosure in which—as in the first exemplary embodiment of FIG. 2—a printing system has a fluid applicator 6 which is situated before a print group 10 along the path 22 of the substrate 19 through the printing system. The details and differences of the second exemplary embodiment of FIG. 3 relative to the first exemplary embodiment of FIG. 2 are explained in the following, wherein the preceding statements regarding FIG. 2 are moreover referenced, in particular concerning the fluid applicator 6, the fluid 38 and its effects, the substrate 19, and the print group 10.

In the second exemplary embodiment of FIG. 3, a regulation of the substrate temperature and of the moisture content of the substrate 19 is implemented that is schematically drawn in FIG. 3. In addition to this, the electrical resistance of the substrate 19 is homogenized and adjusted suitably, for example to a desired low value. In addition to the fluid applicator 6 and the print group 10, respective measurers 54, 56, 64, 66 or 68 are provided to measure measurement values (which are still to be explained) at measurement points 53, 55, 63, 65, 67 during the printing method. A regulator 78 and a database 85 are also provided. For example, the regulator 78 and a database 85 may be realized by means of a computer (not graphically depicted), wherein the database 85 may be designed as a database stored in a memory of the computer.

In detail, in the second exemplary embodiment of FIG. 3 the surface temperature of the substrate 19 is measured at the measurement point 53 by means of a first measurer 54, and thus a first measurement value 54*a* for the substrate temperature is obtained. The measurement takes place by means of the first measurer 54 before the substrate 19 travels into the fluid applicator 6.

The electrical resistance of the substrate 19 in its transversal or thickness direction Q (thus transversal to the substrate surface 20 through the substrate 19)—thus the volume resistance—is also measured at a measurement point 55 that is situated adjacent to the measurement point 53 and likewise before the fluid applicator 6, wherein for this a second measurer 56 is provided that delivers a second measurement value 56*a*.

Furthermore, in the second exemplary embodiment the substrate surface temperature is measured by means of a third measurer 64 at a measurement point 63 after the exit of the substrate 19 from the fluid applicator 6. The substrate surface temperature is also measured at a further measurement point 65 by means of a fourth measurer 66, wherein the measurement takes place by means of the fourth measurer 66 shortly before the substrate 19 travels into the print group 10. In this example, the print group 10 may represent a first print group (which may be followed by additional print groups that are not drawn in FIG. 3). The measurers 64 and 66 deliver third and fourth measurement values 64*a* or 66*a* (see FIG. 3). As shown, the measurement points 63 and 65 are arranged in succession between the fluid applicator 6 and the print group 10 along the path 22 of the substrate 19.

Similar to as at the measurement point 55, the electrical resistance in the transversal direction Q of the substrate 19 is measured by means of a fifth measurer 68 at an additional measurement point 67 in the print group 10, and a measurement value 68*a* is hereby obtained.

For example, the measurement of the substrate surface temperatures by means of the measurers 54, 64, 66 may respectively take place via the measurement of infrared emission (IR emission).

For example, as depicted in FIG. 3, the measurement of the electrical resistance or of the electrical conductivity of the substrate 19 in its transverse direction Q may take place with the aid of conductive rollers 57, 58 between which the substrate 19 travels or—in the case of the print group 10—with the aid of the drums 45, 46, as well as a respective suitable circuit.

The rollers 57, 58 or the drums 45, 46 hereby contact the substrate 19 on its surface on both sides. For example, the electrical resistance may be measured as a kind of "line resistance" between the contact lines of the two rollers 57, 58 or of the two drums 45, 46 with the substrate 19. Given this measurement method, a resistance is obtained as a measured electrical resistance that is averaged over the entire width of the substrate web, transverse to its transport direction 21. The peripheral surfaces of both rollers 57, 58 are entirely conductive, for example. For a given timing frequency of the measurement or sampling frequency, averaged or integrated resistance values for a respective stripe of the moving substrate are thus obtained, wherein the stripe extends over the entire width of the substrate web.

Figure 7:
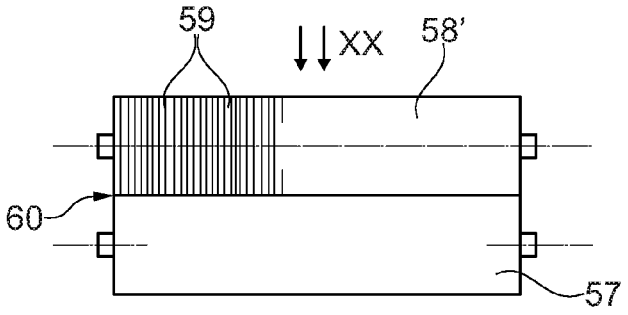
FIG. 7 shows an example of an illustration of a system for measurement of an electrical resistance of a substrate with the aid of two rotating rollers, viewed in the travel direction of the substrate.
Figure 8:
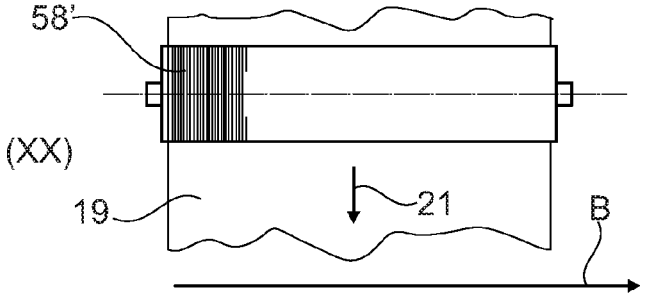
FIG. 8 shows the system of FIG. 7 as well as a substrate, in a plan view XX.

For a homogenization of the electrical resistance of the substrate 19 over the area, the measurement of the electrical resistance may advantageously alternatively take place by means of the system schematically drawn in FIGS. 7 and 8. As an example, the two rollers from FIG. 3 are shown in FIG. 7, wherein in the variant of FIG. 7 one of the two rollers (here the upper roller) is subdivided into narrow discs 59 along its rotation axis, wherein the discs 59 are electrically insulated from one another. The roller subdivided into discs 59 is designated with the reference character 58'. The lower roller corresponds to the roller 57 from FIG. 3 and is conductive over its entire surface. The entire roller 58' may, for example, be made up of a plurality of discs 59 of the same thickness, wherein FIG. 7 schematically illustrates only a portion of the discs 59. The rollers 57, 58' contact the substrate 19 (not visible in FIG. 7) traveling between them in contact lines 60 from its top side and underside. If the current flow between the discs 59 and the roller 57 is measured for a given electrical voltage, clocked with a defined, selected frequency, electrical resistances may be measured for small area regions of the substrate 19 whose dimensions result from the thicknesses of the measurement discs 59, the time intervals of the measurements and the travel velocity of the substrate 19. Due to the smaller measurement surfaces across which the measured resistance is averaged in this variant, a better conclusion may be drawn about the homogeneity or inhomogeneity of the electrical resistance in the area. The obtained information may in turn be used for the purposes of homogenization and possibly adjustment of said electrical resistance, for example in order to determine what amount of fluid is to be applied onto the substrate 19 so that—to improve the print image—the distribution becomes more homogeneous, optimally all inhomogeneities are corrected, and a sought resistance value may be achieved with optimal homogeneity.

Figure 9:
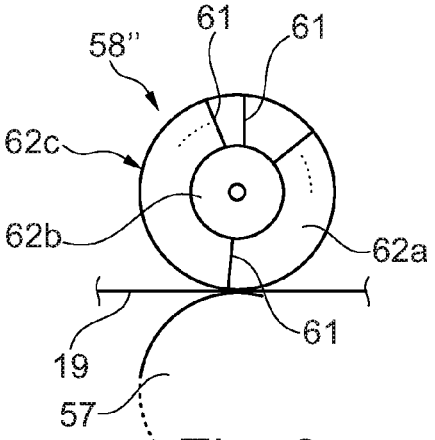
FIG. 9 is a partial view of another example of a system for measurement of an electrical resistance of a substrate with the aid of two rotating rollers, in cross section.

In yet another variant of an arrangement for resistance measurement that is schematically illustrated in a partial view in FIG. 9, the lower roller 57 may be designed as a roller that is conductive over its entire peripheral surface (a steel roller, for example), whereas the upper roller 58" is executed as a rubber drum with an electrically conductive core 62*b* (a steel core, for instance) and an electrically insulating rubber jacket 62*a*. In this variant, electrically conductive metal pins or wires 61 extend through the jacket 62*a* from the circumferential outer surface 62*c* of the roller 58" to the core 62*b*, with which they are respectively connected at their end so as to be electrically conductive. The jacket 62*b* is preferably penetrated by a plurality of (in particular radially extending) pins 61, of which only a small portion is depicted by way of example in FIG. 9. The pins 61 are distributed over the entire axial length and the entire circumference of the roller 58". The distribution of the pins 61 preferably takes place such that two or more pins 61 are not situated axially on a line, meaning that the measurement always takes place only between a single one of the pins 61 and the counter-roller 57. In this way, an even better conclusion may be obtained about the areal homogeneity or inhomogeneity of the electrical volume resistance in the transverse direction Q through the substrate 19.

In one variant (not graphically depicted) of the arrangement of FIG. 9, the diameter of the pins 61 is reduced so much that, by means of the measurement of the resistance, conclusions about its inhomogeneity may be made in a range that is relevant to optical phenomena on the substrate surface 20.

Downstream of the applicator 6, an additional measurement may also take place by means of rollers 57, 58' or 57, 58" (designed corresponding to FIG. 7-9, for example) in order to be able to determine to what extent the sought homogeneity of the electrical resistance of the substrate 19 has been achieved by means of application of the fluid 38.

It is thus clear that, in the systems of FIG. 7-9, the rollers 58, 58" are respectively designed such that their peripheral surface is formed in a plurality of regions with electrically conductive material, wherein surface regions that are designed with an electrically insulating material are located between these conductive regions.

In combination with any of the resistance measurement methods of FIGS. 3, 7, 8 and 9, the fluid 38 may be applied uniformly and in a plane onto the substrate 9 across the width direction B of the substrate web, for instance (as described) by means of drums with cups or the like. However, the resistance measurement—in particular with the systems of FIG. 7 through 9—enables an estimate to be made as to how much fluid 38 is to be applied per area unit in order to sufficiently remedy the optically relevant inhomogeneities.

However, suitable application nozzles (which, for example, could be executed similar to inkjet nozzles) could also apply the fluid 38 to the substrate 19 across its width.

In variants of the exemplary embodiments, such application nozzles could additionally be useful in order to apply the fluid 38 not uniformly in the width direction B of the substrate 19 but rather depending on the resistance measurement for various positions along the width direction B of the substrate web (see FIG. 8), and thus to specifically adjust the applied quantity of fluid 38 for the respective area region in order to achieve the desired homogeneity. In such variants, the occurring inhomogeneities in the electrical resistance, and possible deviations from a target value, would thus be even more specifically reduced or remedied by means of the fluid application.

The measurement of electrical resistances is generally known per se to the person skilled in the art, which is why additional devices and circuits that are used for resistance measurement (in FIG. 3, for example) are only schematically indicated.

As explained with regard to the first exemplary embodiment (see FIG. 2), in the second exemplary embodiment a fluid 38 is applied to the running substrate 19. For example, the amount of fluid 38 applied onto the substrate 19 per area unit during the operation of the printing system may be determined from the travel velocity of the substrate 19 and the fluid throughput of the fluid applicator 6, wherein the throughput of fluid 38 corresponds to the amount of fluid applied onto the substrate 19 per time unit, and may be measured in the fluid applicator 6 in a manner that is known to the person skilled in the art. As an alternative or in addition to a measurement of the fluid throughput in the fluid applicator 6, a determination of the amount of fluid available on the substrate surface 20 may be implemented, for example by means of retroreflectometry with the aid of a glossmeter.

According to the second exemplary embodiment, upon operation of the printing system a data set (see reference character 85*a*) that (for example) includes a nominal substrate temperature and a nominal moisture content of the substrate may initially be provided from the database 85 for a selected substrate 19 which should be printed to in the print group 10, as well as for a given printing method. The database 85 may thus include at least one substrate database that associates substrates of defined types and defined thickness with nominal substrate temperature and nominal moisture contents with which optimized print results may be achieved, and which may be accessed during the printing process. The nominal substrate temperature and nominal moisture contents may also additionally be dependent on the composition of the fluid 38 and be stored in corresponding data sets of the database 85. The preferred operating points to be incorporated into the substrate database may be determined for different substrate types, substrate thicknesses etc., for example via tests.

For example, it may be established that these nominal values (for example the nominal temperature, for instance as a surface temperature of the substrate 19) should optimally be achieved at least at a predefined point or in a predefined segment of the path 22 of the substrate 19 through the printing system, in particular at the location 11 of the printing by means of the print group 10 or multiple such print groups, in order to achieve an optimal print result. Nominal substrate temperature (for instance nominal substrate surface temperature) and nominal moisture content may in many cases be constant over time for a selected substrate 19 and a selected printing method, but in principle could instead also vary over time in a predefined manner. The nominal substrate temperature and the nominal moisture content of the substrate may define a nominal operating point of the printing system, wherein the nominal operating point may be associated with a defined fluid. The printing system may also comprise devices for further processing (see reference characters 15 in FIG. 6) arranged following the actual print group or the actual print groups.

The achieved substrate temperature will normally not correspond at the sought point or in the sought region to the fluid temperature of the fluid 38. The applied quantity of fluid 38 and its fluid temperature are to be selected, depending in particular on printing speed and/or substrate type and/or substrate thickness (thermal capacity) and/or fluid composition (as well as depending on the prior temperature of the substrate 19 measured by means of the measurer 54), in such a manner that the nominal temperature at the sought point or in the sought region is achieved with defined tolerance. This is produced by means of the regulator 78 in the example of FIG. 3.

Dependencies of the fluid quantity and fluid temperature that are required to achieve the nominal substrate temperature on the printing speed, the substrate thickness and/or the substrate type may likewise be stored in the database 85.

In a preferred variant, the database data which is included in the database 85 may, however, alternatively be designed such that optimal operating points are stored for defined substrates, substrate thicknesses and fluid compositions, wherein these optimal operating points are characterized by the fluid temperature, the fluid quantity to be applied and the resulting achieved substrate temperature. To fill the database, an optimal combination of fluid temperature, applied fluid quantity and achieved substrate temperature is hereby preferably determined via tests and stored for different printing speeds. These stored combinations may be accessed during the printing.

For example, for a defined combination of printing methods and substrate type, a preferred fluid composition could additionally be determined (for instance with a view towards a homogenization of a substrate parameter that is to be achieved), likewise with the aid of experiments and tests.

The velocity with which the substrate 19 is transported through the printing system in the direction 21 may be provided by the regulator 78, for example via a controller for the entire printing system.

In the exemplary embodiment of FIG. 3, a regulation of the substrate temperature and additionally of the substrate moisture is implemented during the printing process by means of the regulator 78 so that these optimally reach their nominal values. In the exemplary embodiment schematically depicted in FIG. 3, the regulator 78 takes into account the measurement values 54*a*, 56*a*, 64*a*, 66*a* and 68*a* as well as the information available in the database 85, for example in the form of the nominal operating points. In the event that the measurement of the electrical resistances takes place with the aid of the arrangement of FIGS. 7 and 8, the regulator 78 preferably takes into account the entirety of the obtained individual measurement values. The regulator 78 determines the required fluid temperature of the fluid 38 and its quantity to be applied onto the substrate 19 per time unit, and provides a corresponding output signal 78*a*. The output signal is transmitted (see FIG. 3) to the fluid applicator 6, which applies the fluid 38 onto the substrate 19 per time unit in the amount predetermined by the regulator 78 (i.e. with the throughput established in this manner), and seeks—in reaction to the output signal 78*a*—to achieve the fluid temperature predetermined by the regulator 78 with the aid of the temperature adjuster 37 (see FIG. 2), in order to achieve or maintain the desired nominal operating point. It is clear that a regulation of the substrate temperature, of the substrate moisture and of the electrical resistance is realized in the example of FIG. 3, in which regulation fluid temperature and fluid quantity applied per time unit are controlled depending on the first measurement value 54*a* for the substrate temperature before the application of the fluid 38; on the second measurement value 64*a* for the substrate temperature after the application of the fluid 38; on the measurement values 56*a* and 68*a* for the electrical resistance as a substrate property to be homogenized; and depending on the travel velocity of the substrate 19, in order to achieve or maintain the nominal operating point. Given the described regulation, the fluid temperature and the quantity of fluid 38 applied onto the substrate 19 per time unit may thus be considered as control variables. Optimized conditions for printing and/or further processing may thus be achieved by means of a small number control variables.

Given the determination of the quantity of fluid 38 to be applied and its fluid temperature by means of the regulator 78, it may also in particular be taken into account by this that—as indicated above—the selection of the fluid temperature may influence the penetration into the substrate 19 of additive substances that are included in the fluid 38. The composition may thus be taken into account in the selection of fluid temperature and quantity of fluid 38 to be applied, for example in order to achieve a desired penetration depth of an additive substance into the substrate 19. In other words: for a defined fluid 38, fluid temperature and fluid quantity may be matched to one another in order to achieve the desired penetration.

In the exemplary embodiment of FIG. 3, as explained above the electrical resistance (for example) of the substrate 19 is measured as a substrate property to be homogenized (at the measurement points 55 and 67 in the shown example). In this way, a regulation of the substrate property to be homogenized may be realized, in particular via the adjustment of applied quantity and temperature of a fluid 38 of suitable composition. As an alternative or in addition to the electrical volume resistance, however, one or more additional substrate properties to be homogenized could also be measured at one or more locations along the travel path 22—for example likewise before and after the fluid applicator 6—and a regulation of these additional substrate properties could be implemented.

As drawn in FIG. 3, the measurement of temperature and additional properties of the substrate (for example the electrical resistance) respectively takes place before and after the fluid applicator 6. However, if needed all measurement variables may also be measured at yet more measurement points, for example in the event that this proves to be desirable or useful for the desired regulation. FIG. 7-9 as well as the associated preceding explanations are also referenced regarding the measurement of the electrical resistance.

According to the alternative design of the database as described above, the operating points with the stored combination of fluid temperature and fluid quantity may be taken from this, and the fluid 38 may be applied accordingly to the substrate 19.

In a preferred variant according to the exemplary embodiment of FIG. 3, the printing by means of the print group takes place in a toner-based digital printing method, wherein the fluid 38 serves for the targeted influencing of the substrate temperature at least at the location of the toner transfer in the print group 10, the targeted influencing of the substrate moisture, and the targeted homogenization of the electrical resistance. According to this preferred variant, a regulation of substrate temperature, moisture and electrical resistance is provided by means of the regulator 78 and using the database 85.

It is noted that the regulator 78 and the database 85 may form separate components, may be merged together into one component, or may be integrated into a control device (not shown in Figures) for the entire printing line or printing machine. Significant functions of the regulator 78 and the database 85 may also be realized as software components and be executed with the aid of a data processing device or a computer.

Figure 4:
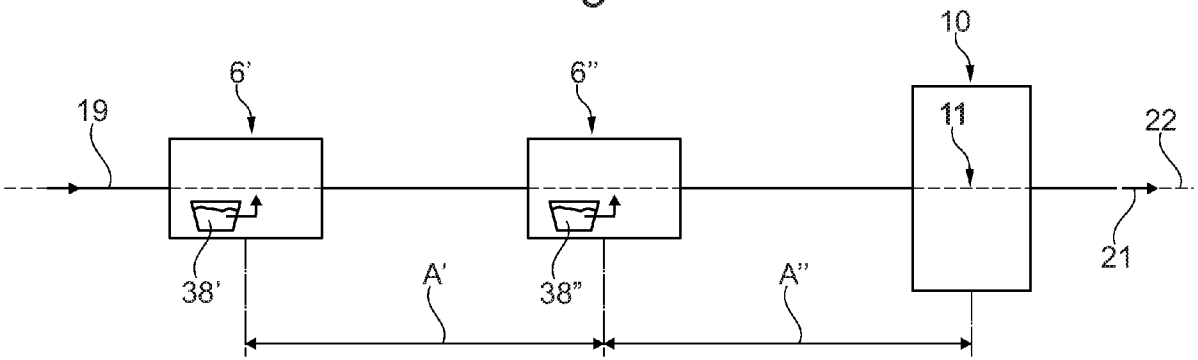
FIG. 4 shows schematically a processing of a substrate according to a third exemplary embodiment of the disclosure.
Figure 5:
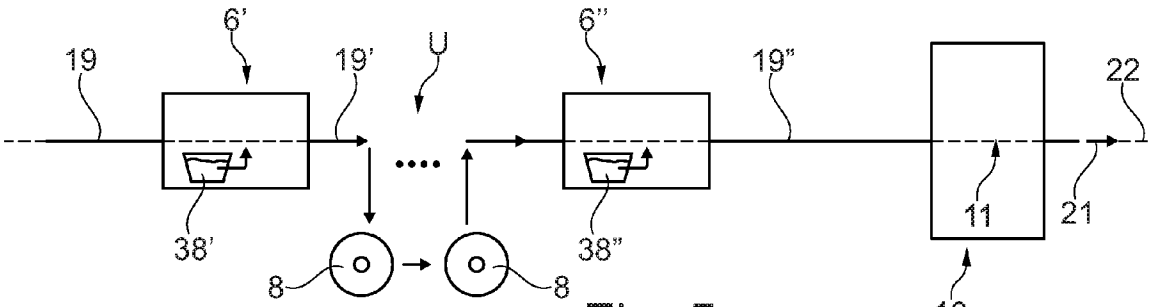
FIG. 5 shows schematically a processing of a substrate according to a fourth exemplary embodiment of the disclosure.

In FIGS. 4 and 5, two possibilities are drawn for applying two fluids 38' and 38" (instead of only one fluid 38) onto the substrate, which possibilities are explained in the following. It is understood that the application of the fluids 38', 38" may in principle take place as in the preceding exemplary embodiments of the disclosure, regarding which the preceding explanations are referenced again. It is thereby understood that a regulation as it has been described by way of example with regard to FIG. 3 may also be implemented in the exemplary embodiments explained with reference to FIGS. 4 and 5, wherein then suitable measurers may be arranged (as described in the preceding) at appropriate locations of the substrate path 22 in order to measure (for example) substrate temperatures (in particular substrate surface temperatures) and substrate parameters to be influenced. Fluid temperatures and fluid quantities may hereby again be considered as control variables. It is understood that the following statements may also reasonably relate to the application of more than two fluids.

As depicted in FIG. 4, instead of being applied in a single step as in FIG. 2, the applied fluid may alternatively be applied onto the substrate 19 in multiple steps. FIG. 4 shows the application of two fluids 38' and 38" (in the form of two liquids) onto the substrate 19 by means of a first fluid applicator 6' and a second fluid applicator 6". The modules 6' and 6" are arranged in succession along the travel path 22 of the substrate 19.

For example, water with at least one first additive substance included therein—for instance a first aqueous solution or aqueous dispersion solution—as a first fluid 38', and water with at least one second additive substance included therein—for instance a second aqueous solution or aqueous dispersion solution—as a second fluid 38", could be applied in succession onto the substrate 19. The application may hereby in principle take place as explained in detail above with regard to the first exemplary embodiment. It may hereby be achieved that the first and second additive substances are conveyed into the inside of the substrate 19 via the penetration of the fluids 38' and 38", such that a sought distribution of the first and second additive substances in the cross section of the substrate 19 or in one or more of the strokes 31, 32, 33, or in the entirety of the strokes 31, 32, 33, is achieved in the transversal direction Q (see for instance FIG. 1). Different additive substances may thus be conveyed to different depths; a stratification or a "depth effect" may consequently be achieved. In other words: a control of the penetration depth(s) of the different additive substances may take place. Via suitable selection of the locations of the application of the fluids 38', 38" along the travel path 22, it may be achieved that the sought distribution of the additive substances or fluid components in the transverse direction Q as well as the sought homogeneity and the target value(s) of the present substrate propert(y/ies) are present at the location 11 of the printing.

In addition to this, a deep penetration of the additive substances may also be assisted via tempering (in particular heating) of one or both fluids 38', 38". The penetration is also accelerated via heating of one or both fluids 38', 38".

In one variant, it is also conceivable to provide only the first fluid 38' as water with an additive substance included therein, whereas the second fluid 38" may essentially be water. In this variant, one or both of the fluids 38', 38" may also respectively be tempered—in particular heated—before the application.

By means of the water application in the second step via the fluid applicator 6", the additive substance that was already introduced in the first step may be conveyed or "pushed in" deeper into the substrate. The distance A' between the application locations of the two fluid applicators 6' and 6" and the distance A" between the application location of the second fluid applicator 6" and the location 11 of the printing by means of the first print group 10 may be selected such that, for a given travel velocity of the substrate 19 in direction 21, the sought distribution of the additive substance or of the multiple additive substances on the substrate surface 20 and in the thickness direction Q and depth of said substrate 19—and in this way the sought homogenization of the selected substrate propert(y/ies)—may be achieved, for example at the location 11 of the printing, in particular under consideration as well of the possibly implemented tempering of one or both of the fluids 38', 38". In addition to this, the distance A', A"—in particular A"—should be selected such that the substrate 19 may be printed to by means of the print group 10, wherein in particular a liquid applied onto the substrate 19 as a fluid 38', 38" should penetrate so far that essentially no reverse lamination may occur in the nip of the print group 10.

In summary, in the example of FIG. 4 the locations of the application of the fluids 38', 38" along the travel path 22 may be selected such that a predefined, sought homogeneity of the selected substrate propert(y/ies)—in particular a respective sought homogeneous value of the substrate propert(y/ies)—and/or a predefined sought distribution of at least one fluid component introduced into the substrate 19 in said substrate 19, or in one or more of the strokes 31-33 (in particular in the direction Q), appears at the location of the printing 11.

In the third exemplary embodiment illustrated in FIG. 4, the application of the two fluids 38' and 38" within the printing line or printing machine takes place in what is known as an inline method, just before the substrate 19 travels into the print group 10. This means that the fluids 38', 38" are applied onto the substrate 19 along the travel path 22 of said substrate 19, and the substrate 19 then travels into the print group 10 as shown in FIG. 4, is printed to and is subsequently rolled up or processed further, for example. In the inline method of FIG. 4, the respective fluid temperature of one or both of the fluids 38', 38" may be specifically adjusted or controlled (the fluids are thus specifically tempered) to control the substrate temperature upon traversal of the printing system. For example, the substrate temperature to be controlled may be any substrate surface temperature at the location 11 or in the region 23, wherein the explanations regarding the preceding exemplary embodiments are referenced in this regard. An increase of the substrate temperature is preferably sought. A heating of the fluids 38', 38" additionally contributes to a faster and deeper penetration of the fluids and the included additives into the substrate 19, whereby a control of the penetration depth of one or more of the components of at least one of the fluids 38', 38" or of one or more additive substances included in at least one of the fluids 38', 38" may take place via the tempering of at least one of the fluids 38', 38".

Given suitable selection of the respective fluid (for instance as water or water with additive substances), the moisture content of the substrate 19 may additionally be specifically influenced or controlled by means of both the application of the first fluid 38' and the second fluid 38".

A targeted influencing of one or more selected substrate properties with the goal of their homogenization (and thus their adjustment), and hereby a preparation of the substrate 19, may advantageously take place with the aid of multiple fluids 38', 38". For example, multiple additive components (for instance binder-like additive substances, salts etc.) that influence one or more substrate properties could be included in one fluid, or the additive components may be distributed among multiple fluids 38', 38". A control or regulation of the one or more selected substrate propert(y/ies) or their homogeneity may be implemented. One or more substrate propert (y/ies) may hereby respectively be measured at one or more selected locations along the travel path 22, in particular before and/or after the application of one or more of the fluids. The amount of the respective fluid 38', 38" that is applied per time unit onto the substrate 19, and the fluid temperature of the respective fluid 38', 38", may respectively be adjusted at least depending on the measurement value or measurement values obtained in this manner. As described above, the respective composition of the fluid 38', 38" may hereby be taken into account as well.

In contrast to this, in a fourth exemplary embodiment of the disclosure that is illustrated in FIG. 5 a first fluid 38' is initially applied onto the substrate 19. In the example of FIG. 5, the substrate 19 is supplied continuously, provided with the first fluid 38' by means of the fluid applicator 6' and then is rolled up again, for example as a paper roll 8 in the case of paper. An interruption in the processing of the substrate 19 is thus present at the point designated with U in FIG. 5.

A substrate 19' prepared via application of the first fluid 38' is present at the point U, for example on the paper roll 8. The fluid 38' may hereby be water with an additive substance, and in particular may be applied onto the substrate 19 for targeted homogenization of one or more selected substrate properties, whereby then a substrate 19' is present on the paper roll 8, in which substrate 19' a homogenization of one or more selected substrate properties—for example the absorption capability and/or the electrical resistance or other properties—has already been implemented, or has been prepared via the application of the first fluid 38', for a defined printing method in which the substrate 19' should be printed to later. The substrate 19' may be placed in interim storage and be printed to later. The substrate 19 could also be prepared for printing in a defined printing method and be delivered as a prepared substrate 19' to a customer for their use especially in such a printing method. For example, in the initial state the substrate 19 may be a conventional offset paper. Via application of the first fluid 38', a prepared substrate 19' is generated which, for example, is prepared paper optimized for a printing in a digital printing method (for example a liquid toner method).

The prepared substrate 19' may be processed at a later desired point in time in a printing line or printing machine. In the exemplary embodiment of FIG. 5, a second fluid 38" is applied onto the substrate 19' before the printing in the print group 10, wherein the substrate leaving the fluid applicator 6" is designated as 19". The second fluid 38" may be water or water with an additive substance, and may for example serve for the homogenization of the electrical conductivity. In variants, an additive substance applied by means of the fluid 38' in a first step may also be conveyed further into the inside of the substrate by means of the application of the second fluid 38". In one variant, a homogenization and adjustment of one or more substrate parameters that was begun with the application of the first fluid 38' may be finished via the application of the additional second fluid 38". The substrate 19' may thus yield an optimized substrate 19" if a fluid applicator 6" that applies the fluid 38" is situated before the print group 10 in the processing.

In the fourth exemplary embodiment of FIG. 5, both the first fluid 38' and the second fluid 38" may be tempered, meaning that the fluid temperature of the respective fluid 38', 38" may be specifically adjusted or controlled. In particular, the fluids 38', 38" may be heated. A heating of the first fluid 38' may enable a faster penetration of this fluid 38' and a deeper penetration of an additive substance included therein into the substrate 19. Similar advantages result given a heating of the second fluid 38", wherein the tempering of the fluids 38', 38" in turn offers the possibility to control the penetration depth of the additive substances. However, a targeted control of the fluid temperature of the second fluid 38" additionally offers the possibility to specifically, advantageously influence a substrate temperature for the subsequent printing in the print group 10, or for a possible further processing in the printing machine, as has already been described above. The application of the first fluid 38' thus takes place "offline", outside of a printing line index or printing machine, for example by means of a separate arrangement or device, whereas the application of the second fluid 38" takes place "inline" within the printing line or printing machine. The application of the first fluid 38' onto the substrate 19 according to the fourth exemplary embodiment may also be designated as an "offline priming".

It is noted that an "offline priming" does not necessarily need to take place in two stages with one fluid application implemented "offline" and one implemented "inline"; rather, a substrate 19 may also be prepared via just one fluid application by means of a fluid applicator. In such a substrate, the substrate properties of interest would then already be homogenized after the one fluid application. Such a substrate could likewise be placed in interim storage for further use, or be delivered to a customer for their use. Multiple fluids could also be applied in succession "offline", as needed.

With regard to a possible cooling of one or both of the fluids 38', 38", the statements already made above with regard to fluid 38 may be referenced. In the preceding examples of FIG. 2-6, a cooling of the fluids 38, 38', 38" may take place in the event that the effects of a temperature decrease are desired. In many cases, however, a heating of the fluids 38, 38', 38" will be preferred due to the advantages explained in detail above.

In variants (which are not graphically depicted) in which more than two fluids are applied before the printing to the substrate 29, in variants of the examples of FIGS. 4 and 5 at least one of the fluids may thus be tempered via heating or cooling before the application onto the substrate 19. Of the fluids, at least one may be applied "offline" and at least one may be applied "inline", wherein due to tempering the fluid(s) applied inline may advantageously be used (as described in the preceding) for targeted influencing and control of the substrate temperature. In the event of more than two applied fluids, the third and additional fluids may also in particular be water, water with additive substance(s), an aqueous solution or an aqueous dispersion solution, as described for the fluids 38, 38', 38", and may also be used to influence the substrate moisture. Penetration depths of respective additives included in the fluids may be influenced with the aid of the tempering. The above statements are referenced with regard to the selection of the locations of the fluid application, in particular of the application of the fluid/fluids applied "inline", in relation to the location of the printing and the substance distributions and substrate properties that are achieved with this.

In developments, the exemplary embodiment may be used given printing to substrates 19 within the scope of the most varied applications, for example given book printing or packaging printing.

The exemplary embodiments described in the preceding enable a substrate (for example paper or cardboard) to be obtained that is prepared for a subsequent printing by means of the fluid 38 or the fluids 38', 38". Physical/chemical framework conditions for the printing and/or further processing may be adjusted by means of the fluids 38, 38', 38", wherein in particular substrate temperature substrate surface temperature and substrate moisture may be specifically influenced and selected substrate parameters may be homogenized.

In the preceding exemplary embodiments, the fluids 38, 38', 38" are preferably liquids. In particular, the fluid 38, 38', 38" may respectively be an aqueous solution, an aqueous dispersion solution or aqueous dispersions, or instead may be water. Emulsions would also be conceivable. In additional variants of the preceding exemplary embodiments, the fluid 38, 38', 38" may be present in a different form, for example in liquid form as an oil or a wax or in gaseous form, for instance as water vapor with or without additive substances.

Possibly necessary measurements of the absorption capability or the wetting capability of the substrate 19 for the homogenization (possibly to be conducted) of these substrate properties may be conducted (for example as prior tests) with the aid of methods that are known as such to the person skilled in the art.

The absorption capability of the substrate may be measured with different methods, for instance via the penetration behavior of a liquid applied onto the substrate surface, wherein the selection of the liquid due to the different molecular properties and their interaction with the substrate components has an influence on the measured penetration time. For example, the methods according to Cobb or Cobb-Unger—known as such to the person skilled in the art—may be used.

If the conditions for a printing process should be characterized, the penetration times for various layer thicknesses should be determined. For example, this may take place with a test design for penetration tests, which test design includes a coating device, an illumination device and a high-speed camera. A doctoring rod may be mounted in the coating device. With the doctoring rod, a defined layer thickness of a liquid is applied onto the substrate to be tested and the intensity of the light reflected on the surface coated with the liquid is measured. The duration of the entire penetration phenomenon is characteristic of substrate, liquid and layer thickness.

Considering the wetting capability of the substrate, with regard to what is known as the contact angle measurement methods may be applied that are likewise known as such to the person skilled in the art and therefore are not explained in detail here.

If an electrostatic charging capability of the substrate 19 should presently be homogenized, a measurement of the electrostatic charging capability may be realized by means of no-contact potential measurement probes. The probe is hereby arranged opposite a conductive counter-electrode that is at ground potential, wherein the substrate 19 is arranged between the potential measurement probe and the counter-electrode.

Moreover, in the exemplary embodiments described in the preceding it is possible to supplement the respective printing system with a system by means of which, during the printing process, it may be established whether the fluid 38, 38', 38" respectively applied in the fluid applicator 6, 6', 6" has sufficiently penetrated so that a subsequent printing in the print group 10 may take place. For example, this may take place in such a manner that the substrate 19 is illuminated upstream of the print group 10 and the intensity of the reflected light is measured. To what extent fluid is still present on the substrate surface 20 may be concluded from the reflection during the printing process. In variants of the exemplary embodiments described in the preceding, the information obtained in this way may enter into the determination of the amount of fluid to be applied, for example diaphragm the regulator 78, such that a problem-free printing may take place.

Given the preceding exemplary embodiments, it may also be provided in variants that one or more component(s) included in the fluid 38 or the fluids 38' and/or 38" exhibit(s) a glass transition in the temperature range in which the application and the printing take place, and if applicable in the further processing. The glass transition temperature of the respective additive or of the respective component may likewise advantageously be used with the assistance of a tempering of substrate and/or fluid(s). For example, this may take place in such a manner that an additive or a fluid component of one of the fluids 38, 38', 38" remains on the surface 20 of the substrate and there undergoes a glass transition while the other components of the fluid 38, 38' or 38" penetrate into the substrate.

If (as a subsequent fluid) an additional liquid that is formed as a mixture strikes such a prepared surface, the glass formed in the region of the surface—like any other liquid given a suitably selected layer thickness—can let penetrate ("transmit") into the substrate a component or multiple components of the subsequent mixture while other components remain "stuck", i.e. are held back. One example for such a behavior could be non-polar substances which are "transmitted" while polar substances or particles remain "stuck".

REFERENCE LIST

1 printing system
3 take-off
4 paper roll
6 fluid applicator
6' fluid applicator
6" fluid applicator
8 paper roll
10 print group
11 location of the printing
15 further or final processor
19 substrate
19' substrate
19" substrate
20 substrate surface
21 travel direction (substrate)
22 path of the substrate
23 region (path of the substrate)
28 raw substrate
31 first stroke (substrate)
32 second stroke (substrate)
33 third stroke (substrate)
35 applicator
36 fluid container
37 temperature adjuster
38 fluid
38' fluid
38" fluid
39 stirrer
45 drum (print group)
46 drum (print group)
53 measurement point
54 measurer
54*a* measurement value
55 measurement point
56 measurer
56*a* measurement value
57 roller
58 roller
58' roller
58" roller
59 disc
60 contact line
61 pin
62*a* rubber jacket
62*b* steel core
62*c* outer surface
63 measurement point
64 measurer
64*a* measurement value
65 measurement point
66 measurer
66*a* measurement value
67 measurement point
68 measurer
68*a* measurement value
78 regulator
78*a* output signal or output signals
85 database
85*a* data
100 environment
A distance
A' distance
A" distance
B width direction (substrate)
L length (printing system)
Q transverse direction (substrate)
U interruption Although preferred exemplary embodiments are shown and described in detail in the drawings and in the preceding specification, they should be viewed as purely exemplary and not as limiting the disclosure. It is noted that only preferred exemplary embodiments are shown and described, and all variations and modifications that presently or in the future lie within the protective scope of the disclosure should be protected.

We claim as our invention:

1. A method to control a temperature of a substrate to be printed to and which exhibits said temperature during a traversal of a printing system, comprising the steps of:

selecting or controlling a fluid temperature of a liquid fluid to be applied onto the substrate to influence said substrate temperature, said fluid being applied onto the substrate before the substrate is printed to; and controlling at least one of said fluid temperature and a quantity of said fluid applied onto the substrate per time unit depending on at least one of a first measurement value for a temperature of said substrate before said application of said fluid and a second measurement value for a temperature of said substrate after said application of said fluid.

2. The method according to claim 1 wherein the substrate temperature is a surface temperature of said substrate.

3. The method according to claim 1 wherein the substrate temperature to be controlled is a temperature which the substrate exhibits upon printing by a print group of the printing system or upon a coating of the substrate.

4. The method according to claim 1 wherein the fluid to be applied onto the substrate is tempered before the application, and the substrate is tempered by the application of the fluid.

5. The method according to claim 1 wherein at least one of moisture content, an electrical resistance, an electrostatic charging capability, an absorption capability, a travel capability, and a wetting capability of the substrate is also influenced by the application of the fluid.

6. The method according to claim 1 wherein the at least one of the fluid temperature and the quantity of the fluid that is applied onto the substrate per time unit are controlled to at least one of: achieve and maintain an operating point which is defined at least by a nominal substrate temperature, and a nominal moisture content of the substrate.

7. The method according to claim 1 wherein a regulation of the substrate temperature to be influenced takes place.

8. The method according to claim 1 wherein the fluid is a primer liquid, a fountain solution or a printing ink.

9. The method according to claim 1 wherein at least one of a targeted homogenization and adjustment of at least one selected substrate property is also caused by the application of the fluid.

10. The method according to claim 1 wherein an electrical resistance of the substrate is measured along a width direction of the substrate transverse to its transport direction at a plurality of measurement points.

11. A printing system for printing to a substrate, comprising:

at least one applicator applying a liquid fluid onto the substrate before the substrate is printed to;

at least one temperature adjustor to bring the fluid to a selected or controlled fluid temperature;

a measurer to measure a temperature of the substrate at least one of: before the application of the fluid and after the application of the fluid; and a controller which controls at least one of the fluid temperature and a quantity of said fluid applied onto the substrate per time unit depending on at least one of a first measurement value for a temperature of said substrate before said application of said fluid and a second measurement value for a temperature of said substrate after said application of said fluid.

12. The printing system according to claim 11 wherein the printing system comprises a digital printer.

13. The system according to claim 11 wherein said temperature of the substrate comprises a surface temperature of the substrate.

14. The system according to claim 11 wherein the substrate temperature to be controlled is a temperature which the substrate exhibits upon printing by a print group of the printing system or upon a coating of the substrate.

15. The system according to claim 11 wherein the fluid to be applied onto the substrate is tempered before the application, and the substrate is tempered by the application of the fluid.

16. The system according to claim 11 wherein at least one of: moisture content, an electrical resistance, an electrostatic charging capability, an absorption capability, a travel capability, and a wetting capability of the substrate is also influenced by the application of the fluid.

17. The system according to claim 11 wherein the at least one of the fluid temperature and the quantity of the fluid that is applied onto the substrate per time unit are controlled to at least one of: achieve and maintain an operating point which is defined at least by a nominal substrate temperature and a nominal moisture content of the substrate.

18. The system according to claim 11 wherein a regulation of the substrate temperature to be influenced takes place.

19. The system according to claim 11 wherein the fluid is a primer liquid, a fountain solution, or a printing ink.

20. The system according to claim 11 wherein at least one of a targeted homogenization and adjustment of at least one selected substrate property is also caused by the application of the fluid.

21. The system according to claim 11 wherein an electrical resistance of the substrate is measured along a width direction of the substrate transverse to its transport direction at a plurality of measurement points.

* * * * *